US006712723B2

(12) United States Patent
You

(10) Patent No.: US 6,712,723 B2
(45) Date of Patent: Mar. 30, 2004

(54) TENNIS RACKET STRINGING MACHINE

(76) Inventor: Min Sun You, 40 Naebang-ri, Sundog-myun, Namyangju-si, Kyunggi-do (KR)

( * ) Notice: Subject to any disclaimer, the term of this patent is extended or adjusted under 35 U.S.C. 154(b) by 0 days.

(21) Appl. No.: 10/220,658

(22) PCT Filed: Mar. 9, 2001

(86) PCT No.: PCT/KR01/00372

§ 371 (c)(1),
(2), (4) Date: Aug. 30, 2002

(87) PCT Pub. No.: WO01/66198

PCT Pub. Date: Sep. 13, 2001

(65) Prior Publication Data

US 2003/0022740 A1 Jan. 30, 2003

(30) Foreign Application Priority Data

Mar. 10, 2000 (KR) ..... 2000/6822 U

(51) Int. Cl.[7] ..... A63B 51/14
(52) U.S. Cl. ..... 473/557; 473/556
(58) Field of Search ..... 473/555, 556, 473/557

(56) References Cited

U.S. PATENT DOCUMENTS 1,530,361 A * 3/1925 Harris ..... 473/555
2,023,641 A * 12/1935 Morton ..... 473/555
3,823,609 A * 7/1974 Miyagawa et al. ..... 73/862.43
5,269,515 A * 12/1993 Chu ..... 473/556
5,338,028 A * 8/1994 Sung ..... 473/556
6,162,139 A * 12/2000 Bassili ..... 473/557

* cited by examiner

*Primary Examiner*—Raleigh W. Chiu
(74) *Attorney, Agent, or Firm*—Birch, Stewart, Kolasch & Birch, LLP

(57) ABSTRACT

Disclosed is a tennis racket stringing machine. The machine comprises racket fastening means including a lower supporting plate on which a head frame of a tennis racket is seated to be securely maintained in a lengthwise direction of the lower supporting plate, a fixed section which is projectedly disposed adjacent to one end of the lower supporting plate and functions to fasten one end of the head frame, a movable section which is disposed adjacent to the other end of the lower supporting plate to be capable of being moved along the lengthwise direction and functions to fasten the other end of the head frame, and a clamp which is located below the lower supporting plate to rotatably support the lower supporting plate; and tensioning force adjusting means separately located from the racket fastening means, for adjusting tensioning force of string installed through the head frame.

6 Claims, 6 Drawing Sheets

PRIOR ART

TENNIS RACKET STRINGING MACHINE

TECHNICAL FIELDS

The present invention relates to a portable tennis racket stringing machine, and more particularly, the present invention relates to a tennis racket stringing machine which enables a user to easily adjust the tension of strings installed through a head frame of a tennis racket.

BACKGROUND ART

Generally, a tennis racket essentially consists of a racket handle, a throat, a head frame and strings. A string which is also called a gut, serves as an energy center of the tennis racket. In other words, a string bed which is formed inside the head frame by installation of the strings through the head frame, is directly brought into contact with a tennis ball to hit the tennis ball. At this time, stroke energy which is generated by a tennis player, is transferred to the tennis ball via the strings.

A natural gut string and a synthetic string are mainly used in a tennis racket. In order to allow a tennis racket to be used under the best condition, the tension force on the strings must be adjusted to be suited to a particular player. Research has shown that four weeks after a string is installed through a head frame an elasticity loss reaches at the maximum 15% in the case of the natural gut string and 20% in the case of the synthetic string. After eight hours an elasticity loss reaches at the maximum 5% in the case of the natural gut string and 15% in the case of the synthetic string. Therefore, even though a string did not break, the string must be changed with a new one every three months, or every six months at the latest.

Also, in a tennis racket, it is, necessary to finely adjust the tension force of strings depending upon a situation. That is to say, by finely adjusting the tension force of strings relying upon a factor such as a season, a temperature, a court surface condition, or the like, it is possible to vary striking power of a string bed for a tennis ball.

Apart from the fact that, although strings of a tennis racket did not break, the strings must be changed with new ones every predetermined period of time, particularly, in the case of a professional tennis player, breakage of strings frequently occurs. When the strings are made of natural gut strings, the breaking of the strings occurs more frequently. Thus, in order to adjust the tension force of tennis racket strings so that the tension force is suited to a particular player, or in order to change a broken string, a tennis racket stringing machine is needed.

Referring to FIG. 1, there is shown a schematic perspective view illustrating a conventional tennis racket stringing machine. Since the conventional tennis racket stringing machine 100 must be constructed in such a way as to create high tension forces, it is usually a large-sized structure. Due to this, it is the norm that the tennis racket stringing machine 100 is located in a tennis shop. Hence, a problem is caused in that a tennis player must travel to the tennis shop so as to change a string or adjust the tension of the strings.

While the tension force of strings must be frequently and finely adjusted relying upon factors such as temperature, humidity, court surface condition, or the like, so as to produce optimum playing efficiency, it is inconvenient that a tennis racket user must leave a tennis court and visit a location which is equipped with a tennis racket stringing machine. This is time-consuming and causes annoyance to the tennis racket user.

Moreover, due to the fact that different tennis racket stringing machines are located in tennis shops, and are respectively configured in such a way as to apply different levels of tension force to the string, a stringing operation must be repeatedly performed through a multitude of times to adjust the tension force to that optimally suited to the user.

DISCLOSURE OF THE INVENTION

Accordingly, the present invention has been made in an effort to solve the problems occurring in the related art, and an object of the present invention is to provide a tennis racket stringing machine in which respective component elements are fabricated in such a way as to be capable of being assembled one with another to allow the machine to be carried around and conveniently used irrespective of time and place, and which provides a simple configuration with a reduced manufacturing cost.

Another object of the present invention is to provide a tennis racket stringing machine which enables the tension force of the strings to be adjusted and whereby the tennis racket to be used under optimum tension force suitable for each tennis player.

In order to achieve the above objects, according to one aspect of the present invention, there is provided a tennis racket stringing machine comprising: racket fastening means including a lower supporting plate on which a head frame of a tennis racket is seated and which has a larger length than the head frame so that the head frame of the tennis racket can be securely maintained on the lower supporting plate in a lengthwise direction of the lower supporting plate, a fixed projecting section which is disposed adjacent to one end of the lower supporting plate and functions to fasten one end of the head frame of the tennis racket, a movable section which is disposed adjacent to the other end of the lower supporting plate in such a way as to be capable of being moved along the lengthwise direction of the lower supporting plate and functions to fasten the other end of the head frame of the tennis racket, and a clamp which is located below the lower supporting plate in such a way as to rotatably support a center portion of the lower supporting plate; and tension force adjusting means brought into close contact with the head frame of the tennis racket and wherein it is separated from the racket fastening means, for adjusting the tension force of strings installed through the head frame, so that the strings can be held under optimum tension force.

According to another aspect of the present invention, the fixed section comprises a fixed shaft which has one end secured to the lower supporting plate and the other end projecting upward, a first upper auxiliary plate which is fitted around the fixed shaft, and a first butterfly nut which is threadedly locked to the other end of the fixed shaft.

According to another aspect of the present invention, the movable section comprises a pair of bent pieces which are formed by a pair of portions of the lower supporting plate which are partially cut and bent downward, a rotating bolt which is rotatably fitted through the pair of bent pieces in such a way as to be supported by the pair of bent pieces and to a circumferential outer surface to which a manipulating wheel is secured at a predetermined position, a movable body which is threadedly coupled with the rotating bolt so that the movable body can be moved along the lengthwise direction of the lower supporting, plate by rotation of the rotating bolt, a movable shaft which has one end secured to an upper surface of the movable body and the other end projecting upward, a second upper auxiliary plate which is fitted around the other end of the movable shaft, and a second butterfly nut which is threadedly locked to the other end of the movable shaft.

According to another aspect of the present invention, the movable section comprises a pair of guide rails which are formed at the other end of the lower supporting plate, a wheel receiving groove which is defined in the lower supporting plate adjacent to the pair of guide rails, a movable block which is assembled with the pair of guide rails so that it can be slid along the pair of guide rails in the lengthwise direction of the lower supporting plate, a movable bolt which has one end secured to the movable block and the other end extending in the lengthwise direction of the lower supporting plate in such a way as to be capable of being moved inward of the lower supporting plate, a manipulating wheel which is received in the wheel receiving groove and is threadedly coupled with the movable bolt so that the movable bolt can be moved along the lengthwise direction of the lower supporting plate by rotation of the manipulating wheel, a movable shaft which has one end secured to an upper surface of the movable block and the other end projecting upward, a second upper auxiliary plate which is fitted around the other end of the movable shaft, and a second butterfly nut which is threadedly locked to the other end of the movable shaft.

According to still another aspect of the present invention, the lower supporting plate is composed of a pair of lower supporting plate halves, a socket portion is defined in a first lower supporting plate half, and a plug portion which is fitted into the socket portion, is formed on a second lower supporting plate half.

According to yet still another aspect of the present invention, the tension force adjusting means comprises a string drawing section, a tension force adjusting section and a motor stopping section; the string drawing section including a squeezing plate which is brought into close contact with the head frame of the tennis racket, a squeezing rod which is coupled to the squeezing plate so that it is aligned with a string installed through the head frame, a string reel which winds up the string connected to the squeezing plate, and a motor for rotatably driving the string reel; the tension force adjusting section including a seesaw plate which has one end coupled to the squeezing rod so that the seesaw plate can be rotated about a center shaft, a coil spring which has one end secured to the other end of the seesaw plate, and a tension force—adjusting dial which is connected to the other end of the coil spring; and the motor stopping section including a projection which is formed on a circumferential outer surface of the squeezing rod at a preselected position, and a limit sensor which is arranged on a moving path of the projection and functions to stop the motor when the projection comes into contact with the limit sensor.

In accordance with the features of the present invention, not only the tension force of tennis racket strings can be finely adjusted to a level which is desired by a user, but the entire structure of the tennis racket stringing machine is simplified, whereby the machine can be easily carried around and conveniently used irrespective of time and place, and it is possible to manufacture the tennis racket stringing machine at reduced cost. Portability of the tennis racket stringing machine according to the present invention is further improved by the fact that a lower supporting plate is composed of a pair of lower supporting plate halves.

BRIEF DESCRIPTION OF THE DRAWINGS

The above objects, and other features and advantages of the present invention will become more apparent after a reading of the following detailed description when taken in conjunction with the drawings, in which.

BEST MODE FOR CARRYING OUT THE INVENTION

Figure 1:
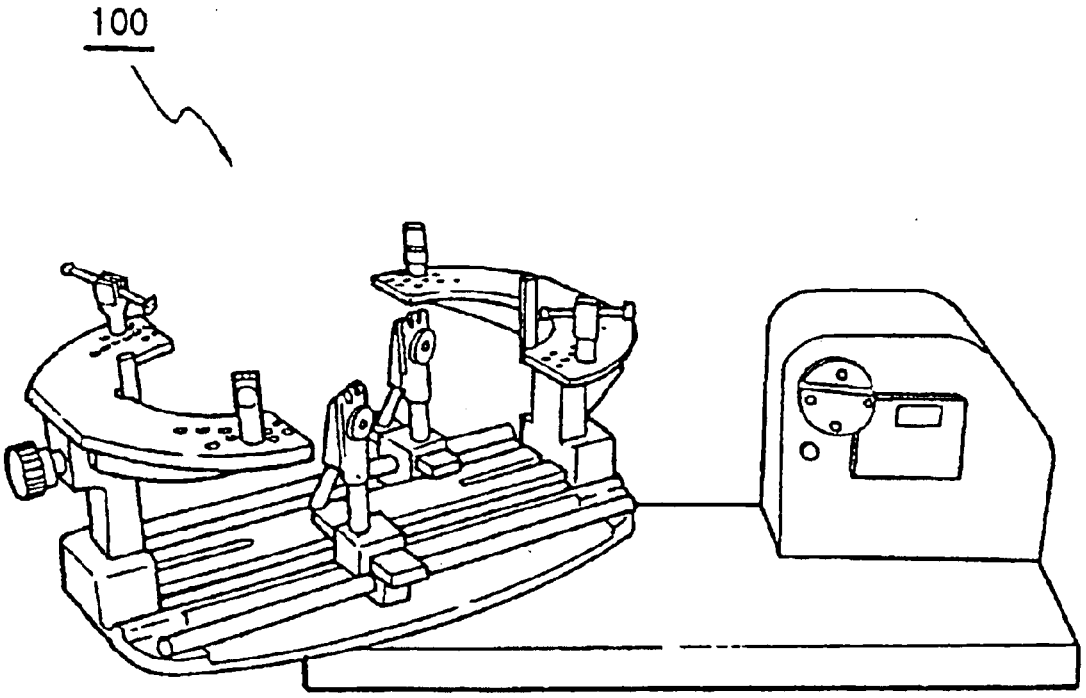
FIG. 1 is a schematic perspective view illustrating a conventional tennis racket stringing machine.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
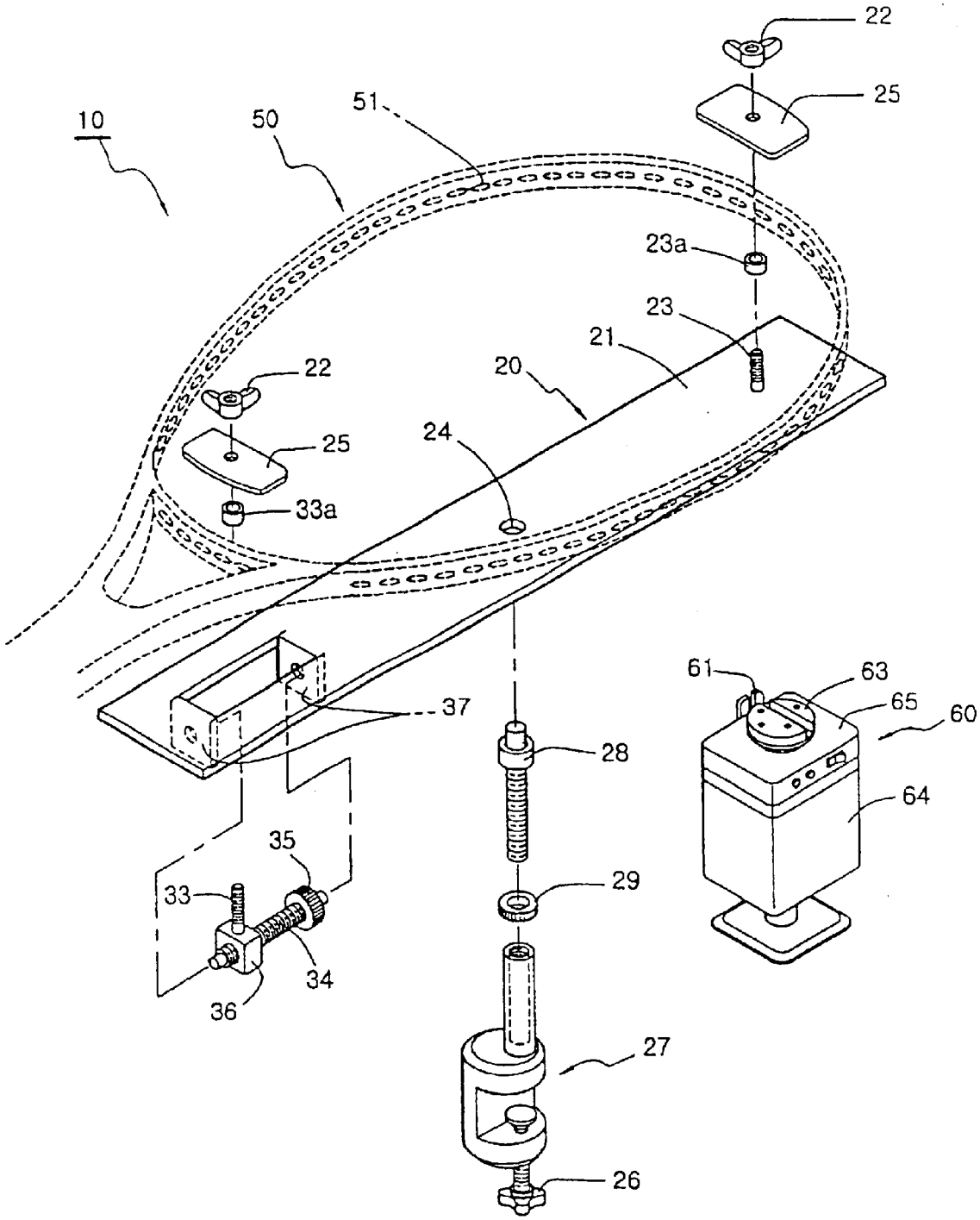
FIG. 2 is an exploded perspective view illustrating an entire structure of a tennis racket stringing machine in accordance with an embodiment of the present invention.
Figure 3:
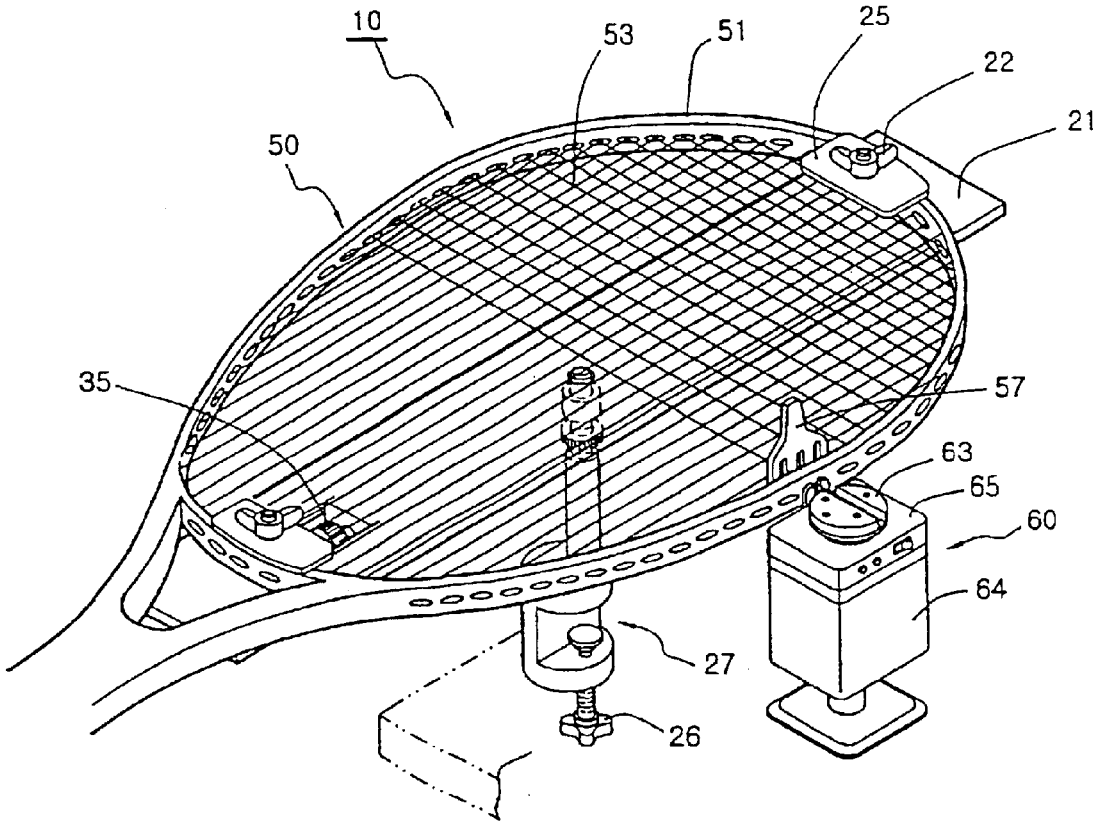
FIG. 3 is a perspective view illustrating the tennis racket stringing machine of FIG. 2 in use.

FIG. 2 is an exploded perspective view illustrating an entire structure of a tennis racket stringing machine in accordance with the present invention; FIG. 3 is a perspective view illustrating the tennis racket stringing machine of FIG. 2 in use; and FIG. 4 is a cross-sectional view illustrating the tennis racket stringing machine of FIG. 2 in use.

As shown in the drawings, a tennis racket stringing machine according to a first embodiment of the present invention, which is designated by the drawing reference numeral 10, includes racket fastening means 20 for fastening a head frame 51 of a tennis racket 50 along a lengthwise direction thereof, and tension force adjusting means 60 separately disposed from the racket fastening means 20, for holding strings 53 (which are installed through the head frame 51), under predetermined tension.

Figure 4:
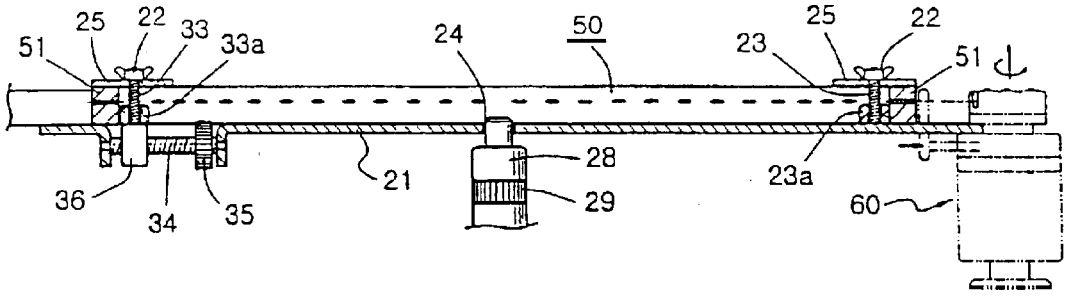
FIG. 4 is a cross-sectional view illustrating the tennis racket stringing machine of FIG. 2 in use.

As shown in FIGS. 2 through 4, the racket fastening means 20 includes a lower support plate 21, a fixed section, a movable section and a clamp 27.

The head frame 51 of the tennis racket 50 is seated on the lower support plate 21. The lower support plate 21 has a larger length than the head frame 51 so that the lower support frame 21 can fasten the head frame 51 of the tennis racket 50 in a lengthwise direction of the lower support plate 21.

The fixed section includes a fixed shaft 23. The fixed shaft 23 has one end which is fastened to an upper surface of the lower support plate 21 adjacent to one end of the lower support plate 21 and the other end which projects upwardly. A threaded portion is formed on a circumferential outer surface of the fixed shaft 23. A first upper auxiliary plate 25 receives the other end of the fixed shaft 23, and a first butterfly nut 22 is threadedly locked to the other end of the fixed shaft 23. In use, the fixed shaft 23 is brought into close contact with one end of the head frame 51 of the tennis racket 50, and by tightening the first butterfly nut 22, the first upper auxiliary plate 25 is pressed against the one end of the head frame 51. Accordingly, the one end of the head frame 51 is maintained in a securely fastened status. When the fixed shaft 23 is brought into close contact with the one end of the head frame 51 of the tennis racket 50, in order to prevent the head frame 51 from being damaged by the threaded fixed shaft 23, a first protective ring 23a is fitted around the fixed shaft 23.

The movable section is disposed adjacent to the other end of the lower supporting plate 21 in such a way as to be capable of being moved along the lengthwise direction of the lower supporting plate 21 and functions to fasten the other end of the head frame 51 of the tennis racket 50. The movable section includes a pair of bent pieces 37. The pair of bent pieces 37 are formed by a pair of portions of the lower supporting plate 21 which are partially cut and bent downward. As shown in FIGS. 2 and 4, a rotating bolt 34 is rotatably fitted through the pair of bent pieces 37 in such a way as to be supported by the pair of bent pieces 37. A manipulating wheel 35 is secured at a predetermined position to a circumferential outer surface of the rotating bolt 34. A movable body 36 is threadedly coupled with the rotating bolt 34. If the rotating bolt 34 is rotated by the rotation of the manipulating wheel 35, the movable body 36 can be moved along the lengthwise direction of the lower supporting plate 21. One end of a movable shaft 33 is secured to an upper surface of the movable body 36, and the other end of the movable shaft 33 projects upwardly. A threaded portion is formed on a circumferential outer surface of the movable shaft 33. A second upper auxiliary plate 25 receives the other end of the movable shaft 33 therethrough, and a second butterfly nut 22 is threadedly locked to the other end of the movable shaft 33. In use, the movable shaft 33 is brought into close contact with the other end of the head frame 51 of the tennis racket 50, and, by tightening the second butterfly nut 22, the second upper auxiliary plate 25 is pressed against the other end of the head frame 51. Accordingly, the other end of the head frame 51 is thereby maintained in a securely fastened status. When the movable shaft 33 is brought into close contact with the other end of the head frame 51 of the tennis racket 50, in order to prevent the head frame 51 from being damaged by the threaded movable shaft 33, a second protective ring 33*a* is fitted around the movable shaft 33.

The clamp 27 is located below the lower support plate 21 and functions to rotatably support a center portion of the lower support plate 21. The clamp 27 includes a rotatable knob 26 which is provided at a lower end thereof. A jaw is formed on an upper end of the knob 26. By rotating the knob 26 and thereby moving the jaw upward, the clamp 27 can be firmly affixed to a desired supporting member such as a desk. A pipe into which a height regulating rod 28 is threadedly fitted, is integrally secured to an upper end of the clamp 27. A nut 29 is threadedly coupled to a circumferential outer surface of the height regulating rod 28. Hence, by rotating the nut 29, it is possible to regulate the height of the height regulating rod 28. An upper end of the height regulating rod 28 is fitted into a hole 24 which is defined at the center of the lower support plate 21. Accordingly, the lower support plate 21 can be freely rotated on the height regulating rod 28.

Figure 5:
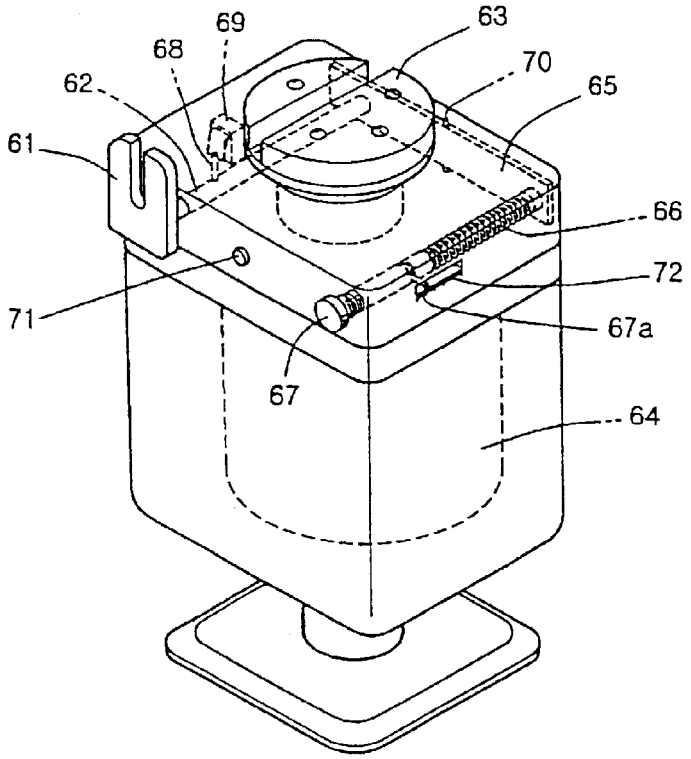
FIG. 5 is a perspective view illustrating the structure of the tension force adjusting means of the tennis racket stringing machine according to the present invention.

The tension force adjusting means 60 is also brought into close contact with the head frame 51 of the tennis racket 50 to a position wherein it is separated from the racket fastening means 20. The means 60 functions to adjust the tension in the strings 53 which are installed through the head frame 51, so that the strings 53 can be held under optimum tension. The tension force adjusting means 60 includes a string drawing section, a tension force adjusting section and a motor stopping section (see FIG. 5). The string drawing section functions to draw the strings 53 through the head frame 51 of the tennis racket 50. The string drawing section includes a squeezing plate 61 which is brought into close contact with the head frame 51 of the tennis racket 50, a squeezing rod 62 which is coupled to the squeezing plate 61 so that it is aligned with a string 53 installed through the head frame 51, a string reel 63 which winds up the string 53 connected to the squeezing plate 61, and a motor 64 for rotatably driving the string reel 63.

The tension force adjusting section includes a seesaw plate 65 which has one end coupled to the squeezing rod 62 so that the seesaw plate 65 can be rotated about a center shaft 70, a coil spring 66 which has one end secured to the other end of the seesaw plate 65, and a tension force adjusting dial 67 which is connected to the other end of the coil spring 66. An indicating pin 67*a* is provided on the tension force adjusting dial 67, and functions to indicate current tension on a scale portion 72 having approximate markings on an outer surface of the tension force adjusting means 60. In order to allow force to be accurately transferred to respective surfaces of the squeezing rod 62 and the coil spring 66 ball members (not shown) are properly arranged on the surfaces, respectively.

The motor stopping section functions to stop the motor 64 when the strings 53 are held under desired tension. The motor stopping section includes a projection 68 which is formed on a circumferential outer surface of the squeezing rod 62 at a preselected position, and a limit sensor 69 which is arranged in the path of movement of the projection 68 and functions to stop the motor 64 when the projection 68 comes into contact with the limit sensor 69. Here, it is preferred that the motor stopping section includes a reset button 71. In this regard, the reset button 71 can rotate the motor 64 by one revolution in a reverse direction so that the string 53 which is wound on the string reel 63, can be smoothly unwound therefrom. The drawing reference number 57 represents a string clamp.

Operation of the tennis racket stringing machine 10 in accordance with the first embodiment of the present invention, constructed as mentioned above, will be described in detail with reference to FIGS. 3 and 4.

When it is necessary to change the string 53 of the tennis racket 50 or adjust the tension of the string 53, a user first affixes the clamp 27 to a desired supporting member such as a desk. At this time, the racket installation height may be adjusted by rotating the nut 29 of the clamp 27 and thereby causing movement of the height regulating rod 28 in upward and downward directions.

Thereafter, the head frame 51 of the tennis racket 50 is fastened to the lower supporting plate 21. In other words, the first and second protective rings 23*a* and 33*a* are respectively fitted around the fixed shaft 23 and the movable shaft 33 so as to prevent the head frame 51 from being damaged by the threaded fixed shaft 23 and the threaded movable shaft 33 when the fixed shaft 23 and the movable shaft 33 are brought into contact with the head frame 51. One end and the other end of the head frame 51 are positioned on the fixed section and the movable section of the racket fastening means 20, respectively. At this time, position alignment between the other end of the head frame 51 and the movable section of the racket fastening means 20 is effected by the rotation of the manipulating wheel 35 and the rotating bolt 34 to axially shift the movable shaft 33 thereby. Thereafter, by tightening the first and second butterfly nuts 22, the first and second upper auxiliary plates 25 press the head frame 51 against the lower support plate 21, and thereby maintain head frame 51 in securely fastened position. By this, the head frame 51 of the tennis racket 50 is supported in a manner such that the strings 53 can be installed therethrough.

A string changing method is commonly applied to all tennis rackets, and therefore, main strings and cross strings must be knotted separately. That is to say, four knots must be formed, and the main string and the cross string should be knotted while they are drawn one by one by the string reel 63. As a consequence, the user can wind the main string and the cross string in regular sequence on the string reel 63 which draws the strings 53 with the predetermined force, and then, can knot the main string and the cross string with each other while clamping first wound string 53 using the string clamp 57 in such a way as not to allow the first wound string 53 to be unwound from the string reel 63. Since the lower support plate 21 is configured in a manner such that it can be rotated on the clamp 27, the main strings and the cross strings can be wound on the string reel 63 while, being rotated.

To obtain a desired tension, the dial 67 is rotated until the desired tension force is indicated on scale 72. This causes the coil spring to exert a force against the plate 65 to rotate it about shaft 70 and push plate 61 outwardly through the rod 62. The plate 61 is placed in contact with head 50 and the string attached to reel 63. As the reel 63 rotates the tension in the string increases and the head 50 moves the plate 61 rearwardly causing the plate 65 to rotate about shaft 70 against the force of coil spring 66. When the projection 68 engages the limit sensor, the motor 64 stops. Hence, the tension force of the string will be equal to the preset force indicated by the scale 72.

Figure 6:
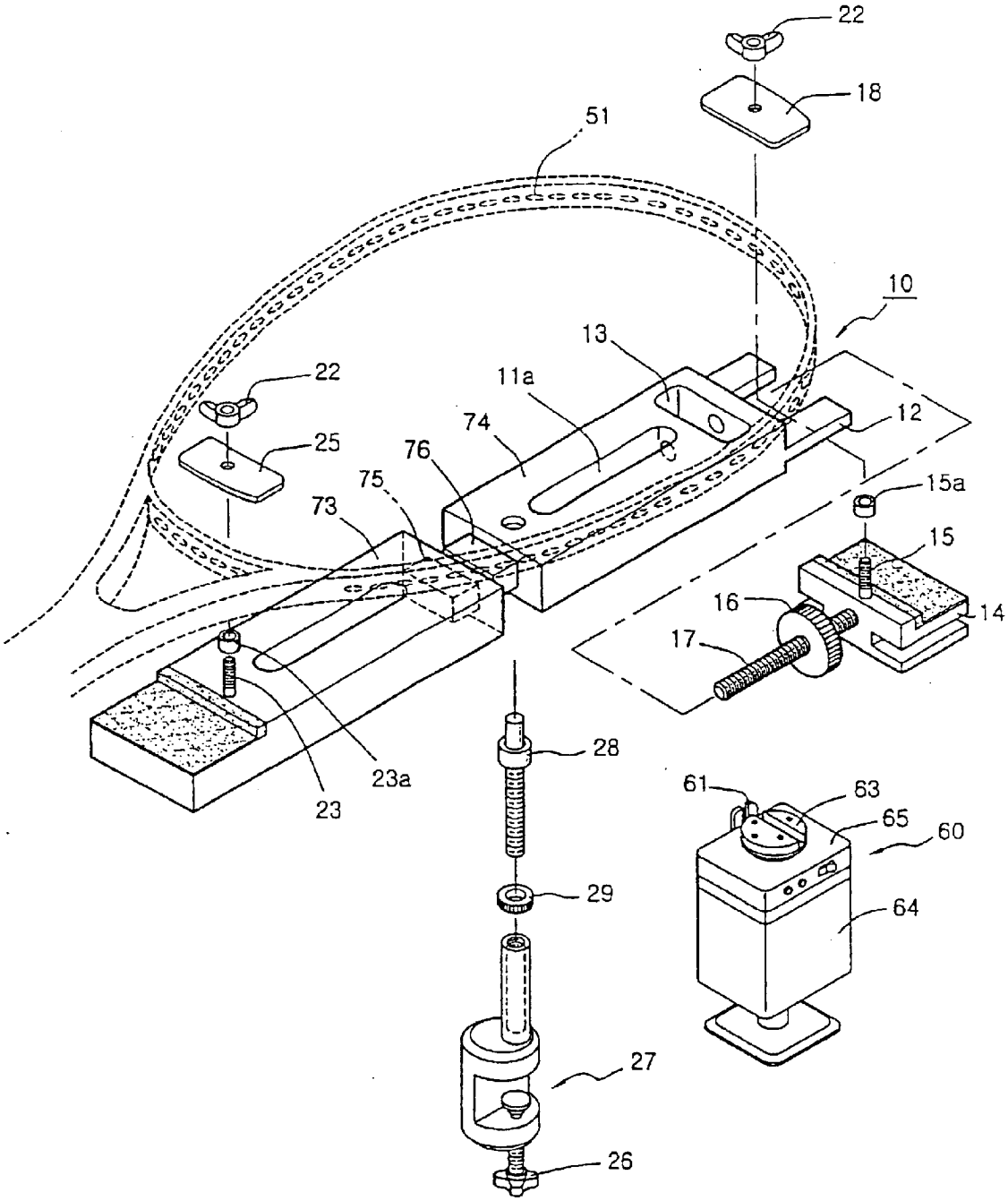
FIG. 6 is an exploded perspective view illustrating the structure of a tennis racket stringing machine in accordance with another embodiment of the present invention.
Figure 7:
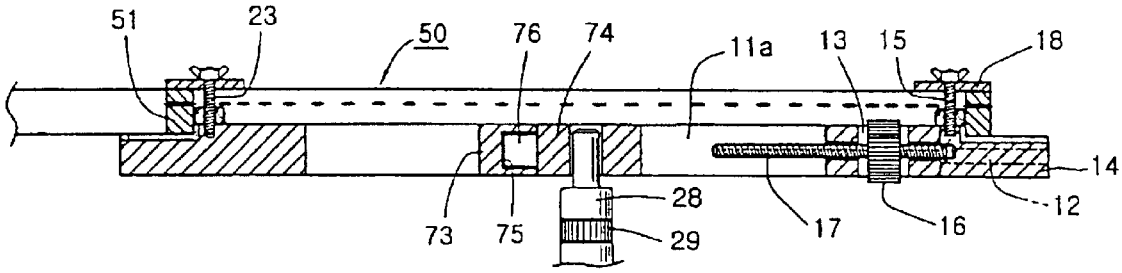
FIG. 7 is a cross-sectional view illustrating the tennis racket stringing machine of FIG. 6 in use.

FIG. 6 is an exploded perspective view illustrating an entire structure of a tennis racket stringing machine in accordance with another embodiment of the present invention; and FIG. 7 is a cross-sectional view illustrating the tennis racket stringing machine of FIG. 6 in use.

In a tennis racket stringing machine in accordance with this second embodiment of the present invention, only the differences in the racket fastening means with respect to the first embodiment of the present invention is shown. Thus, only the differences existing therebetween will be described hereinbelow.

In this embodiment of the present invention, a lower support plate 11 is composed of a pair of lower support plate halves 73 and 74. A socket portion 75 is defined in a first lower support plate half 73, and a plug portion 76, which is fitted into the socket portion 75, is formed on a second lower support plate half 74.

A pair of guide rails 12 are formed at one end of the second lower support plate half 74. A wheel receiving groove 13 is defined through the second lower supporting plate half 74 adjacent to the pair of guide rails 12. An accommodating slot 11*a* is defined through the second lower supporting plate half 74 adjacent to the wheel receiving groove 13. The movable section of the racket fastening means according to this embodiment of the present invention includes a movable block 14. The movable block 14 is assembled with the pair of guide rails 12 so that it can be slid along the pair of guide rails 12 in the lengthwise direction of the lower supporting plate 11. Both sides of the movable block 14 are respectively defined with a pair of guide grooves so that the pair of guide rails 12 can be engaged into the pair of guide grooves, respectively. A movable bolt 17 is secured at one end of the movable block 14. The other end of the movable bolt 17 movably projects into the accommodating slot 11*a* through the wheel receiving groove 13, which is defined through the second lower supporting plate half 74. A manipulating wheel 16 is received in the wheel receiving groove 13. The manipulating wheel 16 is threadedly coupled with the movable bolt 17 so that the movable bolt 17 can be moved along the lengthwise direction of the lower supporting plate 11 by rotation of the manipulating wheel 16. One end of a shaft 15 is secured to an upper surface of the movable block 14. The other end of the shaft 15 projects upwardly. A threaded portion is formed on a circumferential outer surface of the movable shaft 15. A second upper auxiliary plate 18 receives the other end of the movable shaft 15, and then, a second butterfly nut 22 is threadedly locked to the other end of the shaft 15. Hence, when the shaft 15 is brought into close contact with an end of the head frame 51 of the tennis racket 50, tightening the second butterfly nut 22 causes the second upper auxiliary plate 18 to be pressed against the end of the head frame 51, and thereby, the end of the head frame 51 can be maintained in a securely fastened status. In order to prevent the head frame 51 from being damaged by the threaded shaft 15, a second protective ring 15*a* is fitted around the movable shaft 15.

Instead of having one end of the movable shaft 15 secured to the upper surface of the movable block 14 as shown in FIG. 6, the shaft 15 can be integrally secured to the second butterfly nut 22 as shown in FIG. 7. Of course, in this case, it is to be readily understood that a threaded hole into which the shaft can be threadedly fitted, must be defined in the movable block 14.

Consequently, as a user rotates the manipulating wheel 16 and thereby causes the movable block 14 to be moved along the lengthwise direction of the lower supporting plate 11, the head frame 51 of the tennis racket 50 can be easily fastened to the lower supporting plate 11.

Industrial Applicability

As a result, the tennis racket stringing machine according to the present invention provides advantages in that, since tensioning force of a tennis racket can be finely adjusted to a level which is desired by a user, and the entire structure of the tennis racket stringing machine is simplified, the machine can be easily carried around and conveniently used irrespective of time and place. Moreover, it is possible to manufacture the tennis racket stringing machine with a reduced cost. Portability of the tennis racket stringing machine according to the present invention is further improved by the fact that a lower supporting plate is composed of a pair of lower supporting plate halves.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A tennis racket stringing machine comprising:

racket fastening means including a lower support plate on which a head frame of a tennis racket is adapted to be seated and which has a longer length than the head frame, whereby the head frame of the tennis racket can be securely maintained on the lower support plate in a lengthwise direction of the lower support plate, a fixed upwardly projecting section positioned adjacent to one end of the lower support plate and adapted to fasten one end of the head frame of the tennis racket to said support plate, a movable section adjacent to the other end of the support plate in such a way as to be capable of being moved along the lengthwise direction of the lower support plate, and adapted to fasten the other end of the head frame of the tennis racket to said support plate, and a clamp connected to and located below the lower support plate to rotatably support a center portion of the lower support plate; and tension force adjusting means movable into contact with the head frame of the tennis racket for adjusting the tension force of strings installed through the head frame.

2. The tennis racket stringing machine as in claim 1, wherein the fixed section comprises a fixed shaft which has one end secured to the lower support plate and the other end projects upwardly, a first upper auxiliary plate which receives the fixed shaft therethrough, and a first butterfly nut which is threadedly locked to the other end of the fixed shaft.

3. The tennis racket stringing machine as in claim 1, wherein the movable section comprises a pair of bent pieces depending from the lower surface of said support plate, a rotating bolt rotatably connected to said pair of bent pieces and supported thereby, said bolt having a circumferential outer surface, a manipulating wheel connected to the circumferential outer surface of said bolt at a predetermined position, a movable body threadedly connected with the rotating bolt whereby the movable body is moved along the lengthwise direction of the lower support plate by rotation of the rotating bolt, a shaft which has one end secured to an upper surface of the movable body and the other end projects upwardly, a second upper auxiliary plate which receives the other end of the movable shaft therethrough, and a second butterfly nut which is threadedly locked to the other end of the shaft.

4. The tennis racket stringing machine as in claim 1, wherein the movable section comprises a pair of guide rails which are formed at the other end of the lower support plate, a wheel receiving groove in the lower support plate adjacent to the pair of guide rails, a movable block slidably connected to said pair of guide rails whereby said block is slidable along the pair of guide rails in the lengthwise direction of the lower support plate, a movable bolt having one end secured to the movable block and the other end extending in the lengthwise direction of the lower support plate and movable inwardly of the lower support plate, a manipulating wheel received in said wheel receiving groove and threadedly connected to said movable bolt so that the movable bolt can be moved in the lengthwise direction of the lower support plate by rotation of the manipulating wheel, a shaft which has one end secured to an upper surface of the movable block and the other end projecting upwardly, a second upper auxiliary plate which receives the other end of the movable shaft therethrough, and a second butterfly nut which is threadedly locked to the other end of the movable shaft.

5. The tennis racket stringing machine as in claim 4, wherein the lower support plate comprises a pair of lower support plate halves, a socket portion defined in one of said lower support plate half, and a plug portion receivable in said socket portion on the other of said lower support plate half.

6. The tennis racket stringing machine as in claim 1, wherein the tension force adjusting means comprises a string drawing section, a tension force adjusting section and a motor stopping section; the string drawing section including a squeezing plate which is adapted to be brought into contact with the head frame of the tennis racket, a squeezing rod which is coupled to the squeezing plate so that it is aligned with a string installed through the head frame, a string reel which winds up the string, and a motor for rotatably driving the string reel; the tension force adjusting section including a seesaw plate rotatable about a center shaft, one end of said plate being coupled to the squeezing rod so that the seesaw plate can be rotated about said center shaft, a coil spring which has one end secured to the other end of the seesaw plate, and a tension force adjusting dial which is connected to the other end of the coil spring; said motor stopping section including a projection which is formed on a circumferential outer surface of the squeezing rod at a preselected position, and a limit sensor which is arranged in the path of movement of the projection and functions to stop the motor when the projection comes into contact with the limit sensor.

* * * * *